US007290617B2

(12) United States Patent
Popilian et al.

(10) Patent No.: US 7,290,617 B2
(45) Date of Patent: Nov. 6, 2007

(54) RUNNING A COMPLETION ASSEMBLY WITHOUT KILLING A WELL

(75) Inventors: Constantin V. Popilian, Calgary (CA); Stephen P. Lemp, Calgary (CA); Gary Gill, Calgary (CA)

(73) Assignee: Schlumberger Technology Corporation, Sugar Land, TX (US)

( * ) Notice: Subject to any disclaimer, the term of this patent is extended or adjusted under 35 U.S.C. 154(b) by 264 days.

(21) Appl. No.: 10/905,563

(22) Filed: Jan. 11, 2005

(65) Prior Publication Data

US 2005/0150659 A1 Jul. 14, 2005

Related U.S. Application Data

(60) Provisional application No. 60/521,640, filed on Jun. 9, 2004, provisional application No. 60/536,083, filed on Jan. 13, 2004.

(51) Int. Cl.
*E21B 43/10* (2006.01)
*E21B 23/00* (2006.01)

(52) U.S. Cl. ..... 166/386; 166/378; 166/181; 166/192

(58) Field of Classification Search ..... 166/378, 166/382, 386, 387, 179, 181, 192, 123
See application file for complete search history.

(56) References Cited

U.S. PATENT DOCUMENTS

| | | | | |
|---|---|---|---|---|
| 3,598,183 | A * | 8/1971 | Scott | 166/305.1 |
| 3,662,831 | A * | 5/1972 | Hess | 166/295 |
| 3,662,833 | A * | 5/1972 | Kisling, III | 166/373 |
| 3,722,594 | A * | 3/1973 | Smith et al. | 166/307 |
| 3,957,115 | A * | 5/1976 | Kerzee et al. | 166/297 |
| 4,510,999 | A * | 4/1985 | George et al. | 166/297 |
| 4,796,707 | A * | 1/1989 | Halbardier | 166/387 |
| 4,928,762 | A * | 5/1990 | Mamke | 166/192 |
| 5,343,956 | A * | 9/1994 | Coronado | 166/387 |
| 5,505,260 | A | 4/1996 | Andersen et al. | |
| 5,749,419 | A * | 5/1998 | Coronado et al. | 166/387 |
| 5,954,137 | A * | 9/1999 | Coronado et al. | 166/387 |
| 6,056,055 | A * | 5/2000 | Falconer et al. | 166/297 |
| 6,065,550 | A * | 5/2000 | Gardes | 175/62 |
| 6,142,226 | A | 11/2000 | Vick | |
| 6,152,232 | A | 11/2000 | Webb et al. | |
| 6,209,663 | B1 | 4/2001 | Hosie | |
| 6,343,658 | B2 | 2/2002 | Webb | |
| 6,745,855 | B2 | 6/2004 | Gardes | |

(Continued)

FOREIGN PATENT DOCUMENTS

| | | |
|---|---|---|
| WO | WO01/25595 A1 | 4/2001 |

*Primary Examiner*—David Bagnell
*Assistant Examiner*—Shane Bomar
(74) *Attorney, Agent, or Firm*—Trop, Pruner & Hu, P.C.; Bryan P. Galloway; Tim Curington

(57) ABSTRACT

A technique to place a completion assembly in a well while maintaining the well in an underbalanced condition includes running a plug on a deployment tool to a desired depth in the well. The technique includes setting the plug in the well; retrieving the deployment tool; and running the completion assembly on a setting tool into the well to engage the plug. The technique includes releasing the plug; running the completion assembly and plug to a desired depth in the well; and setting the completion assembly in the well. The setting tool is retrieved, which includes retrieving the plug.

21 Claims, 8 Drawing Sheets

U.S. PATENT DOCUMENTS 7,086,481 B2 * 8/2006 Hosie et al. ..... 166/387
2003/0024712 A1 * 2/2003 Neal et al. ..... 166/386
2003/0196806 A1 10/2003 Hromas et al.
2005/0034854 A1 * 2/2005 Curtis et al. ..... 166/117

* cited by examiner

RUNNING A COMPLETION ASSEMBLY WITHOUT KILLING A WELL

This application claims the benefit of U.S. Provisional Application 60/536,083 filed on Jan. 13, 2004 and U.S. Provisional Application 60/521,640 filed on Jun. 9, 2004.

BACKGROUND

1. Field of Invention

The present invention pertains to placing a completion assembly in a well, and particularly to placing a completion assembly in a well while keeping the well in an underbalanced condition.

2. Related Art

It is often desirable to place completion equipment such as a sand screen, for example, in a well without exceeding formation pressures. Exceeding formation pressures can damage the formation, disrupt a mud cake barrier, or otherwise inhibit production of well fluids. Limiting the wellbore pressure to be equal to or less than the formation pressure is known as maintaining an underbalanced condition in the well. Placing a completion assembly in a well while holding the well in an underbalanced condition can be hazardous because wellbore fluids will naturally flow from a region of high pressure to a region of lower pressure, including the surface. That can lead to uncontrolled production, known in the art as a blowout.

SUMMARY

The present invention provides for an apparatus and method to deploy a completion assembly into a well while maintaining the well in an underbalanced condition.

Advantages and other features of the invention will become apparent from the following description, drawings, and claims.

DETAILED DESCRIPTION

Figure 1:
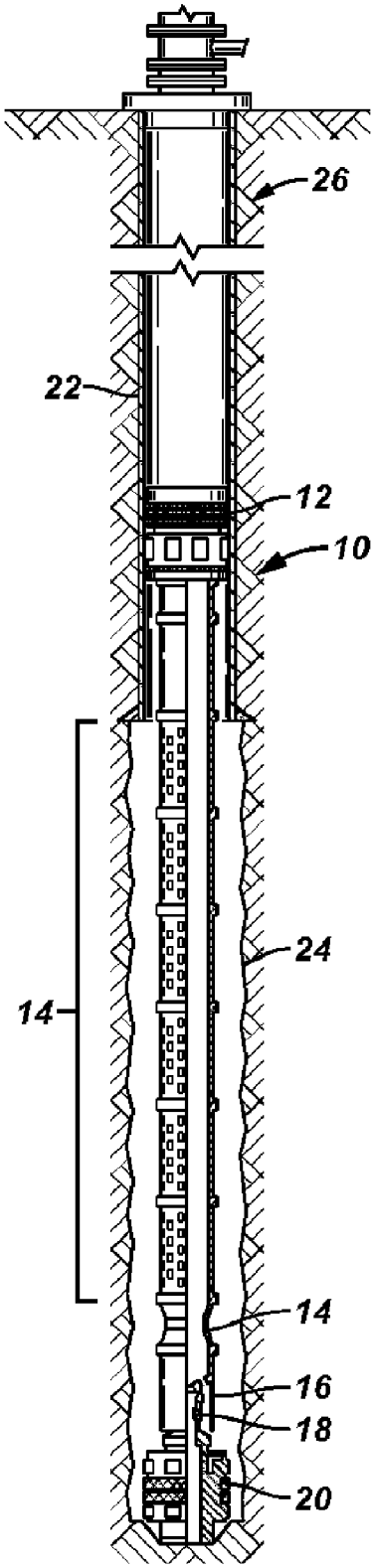
FIG. 1 shows a schematic view of a completion assembly constructed in accordance with the present invention.

Referring to FIG. 1, a completion assembly 10 comprising a liner hangar 12, a sand control device 14, a crossover 16, an overshot 18, and a bridge plug 20 is shown disposed in a casing 22 and an open well bore 24 in a well 26.

Liner hangar 12 is used to secure assembly 10 to casing 22 and to form a seal to prevent fluid flow between hangar 12 and casing 22. Sand control device 14 can be a slotted liner, a wire-wrapped screen, a mesh-covered perforated base pipe, or other filtering device used to exclude fines or other particulates from a production stream. FIG. 1 shows sand control device 14 attached to and suspended from hangar 12.

Crossover 16 is shown mounted between the lower end of sand control device 14 and the upper end of overshot 18.

Overshot 18 mounts to the lower end of crossover 16 and has a release mechanism designed to release bridge plug 20 from a set position. Overshot 18 engages bridge plug 20 when run sufficiently far into well 26, as described further below.

Bridge plug 20 can be, for example, a wireline-set retrievable bridge plug, a mechanically-set retrievable bridge plug, or an inflatable bridge plug, however any plugging device suitable to suspend production of well fluids from below plug 20 may be used. A double flapper check valve (not shown), a pump out plug (not shown), a plug catcher (not shown), a circulating nozzle (not shown), or other component may be included as part of bridge plug 20 if an application requires such components. Bridge plug 20 has a release mechanism that, when engaged by overshot 18, causes the slips (or inflation bladder) securing bridge plug 20 to casing 22 to retract, thereby freeing bridge plug 20.

Figure 2:
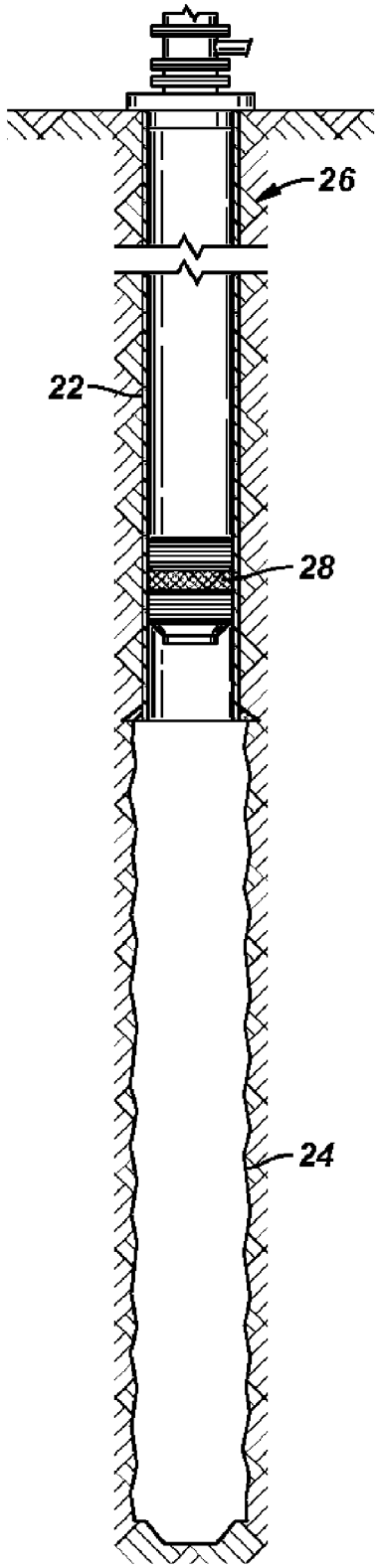
FIG. 2 (Prior Art)
FIG. 2 shows a schematic view of a representative well (prior art) in which the completion assembly of FIG. 1 can be run.
Figure 3:
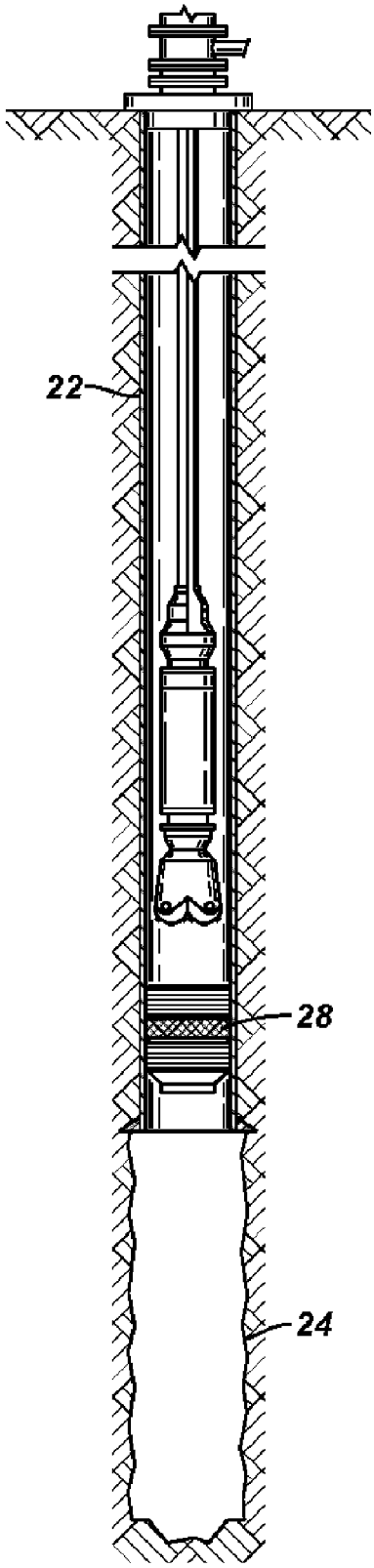
FIGS. 3, 4, and 5 show schematic views illustrating different steps in a method performed in accordance with the present invention.

FIG. 2 shows a representative existing well 26 in which the present invention has application. Production in well 26 is impeded because of, for example, infill (not shown). Because of the poor flow, production has been suspended and well 26 plugged with a composite plug 28. To refurbish well 26 in accordance with the present invention, composite plug 28 is removed, for example, by drilling, as shown in FIG. 3. The well is blown dry and an underbalancing fluid such as nitrogen-foamed water is injected. Thus, well 26 is held in an underbalanced condition.

Figure 4:
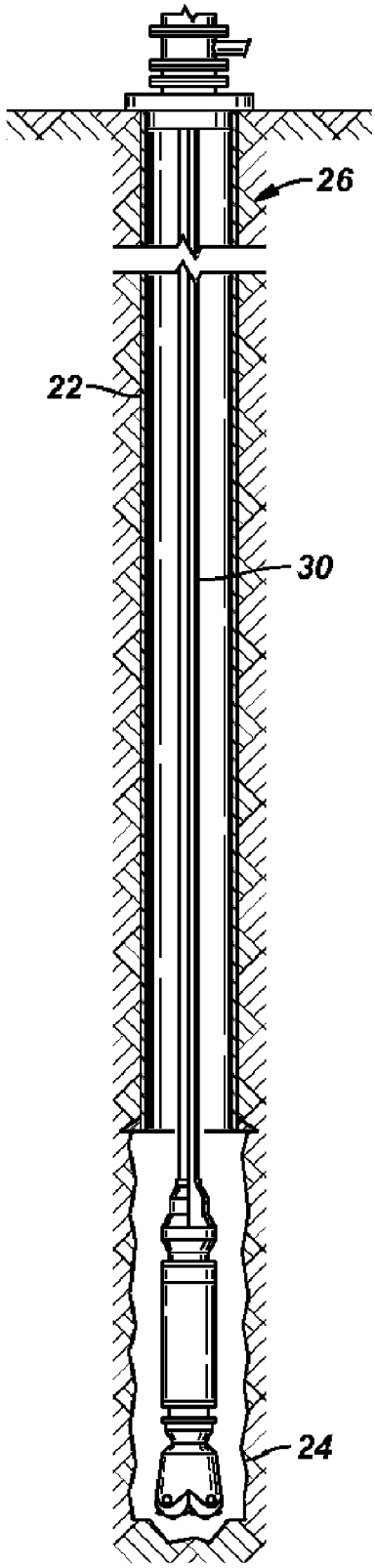

Drilling proceeds until the bottom of well bore 24 is reached, as shown in FIG. 4. Well 26 is circulated to remove the drilled debris and clean out well bore 24. The drilling assembly is then removed and, if desired, an underreaming tool can be run in and well bore 24 underreamed. Drilling debris is again circulated out of well 26 to leave well bore 24 clean.

Figure 5:
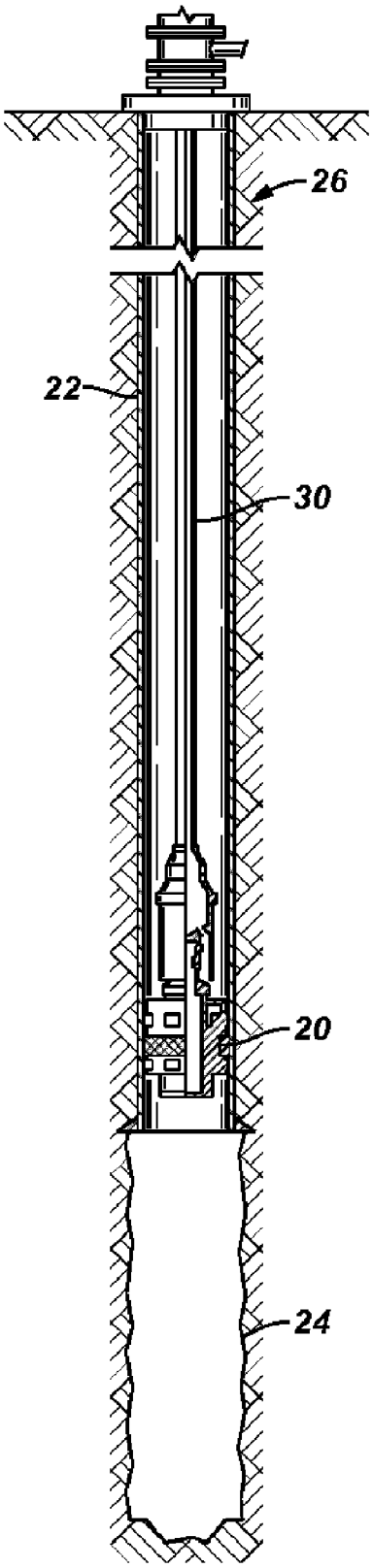

Bridge plug 20 is run into well 26 on coiled tubing 30 and set against casing 22, as shown in FIG. 5. That seals off well bore 24 and holds well 26 in an underbalanced state. Pressure above bridge plug 20 is bled off and coiled tubing 30 is removed from well 26.

Completion assembly 10 can be assembled by attaching overshot 18 to the lower end of crossover 16, which is in turn connected to a joint of sand screen 14. As many joints of sand screen 14 as are necessary can be joined to form the length necessary for well 26. This can be done as a single operation because the assembly is not done in a lubricator of limited length. The operator has the entire upper portion of well 26, that is, the portion above bridge plug 20, in which to assemble completion assembly 10. When sand screen 14 is of sufficient length, tubing hangar 12 is attached to the upper end of sand screen 14 and the entire assembly 10 is run into well 26 using, for example, coiled tubing 30.

Upon encountering bridge plug 20, overshot 18 engages bridge plug 20 and the release mechanism in overshot 18 works in conjunction with the mating release mechanism in bridge plug 20 to release bridge plug 20 from casing 22, as is well known in the art. Bridge plug 20 attaches to overshot 18 upon engagement by overshot 18 and is moved to the bottom of well bore 24. Upon reaching the desired depth, liner hangar 12 is set to fix it to casing 22. Once liner hangar 12 is set, coiled tubing 30 can be removed and well 26 is ready for further completion operations such as a gravel pack, or to be placed back on production.

Figure 6:
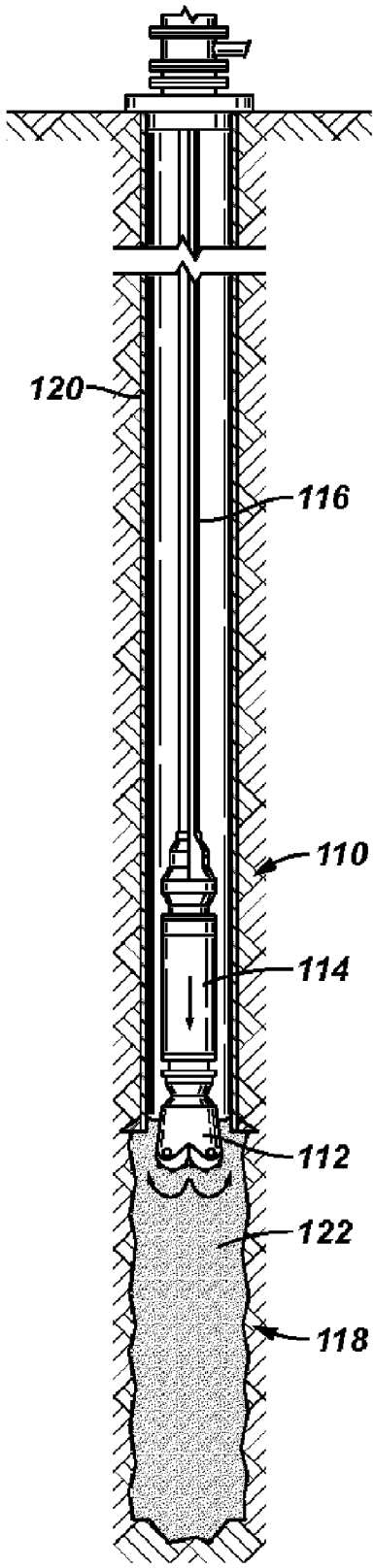
FIGS. 6 through 15 show schematic views illustrating different steps in a method performed in accordance with the present invention.

Alternatively, referring to FIG. 6, a work assembly 110 comprises a drill bit 112, a mud motor 114, and a coiled tubing 116. The assembly 110 is shown disposed in a well 118 having a casing 120 in an upper portion of well 118 and an open well bore 122 in a lower portion of well 118. Work assembly 110 is used to clean out well 118 by removing fill. Once the fill is circulated out of well 118, work assembly 110 is removed.

Figure 7:
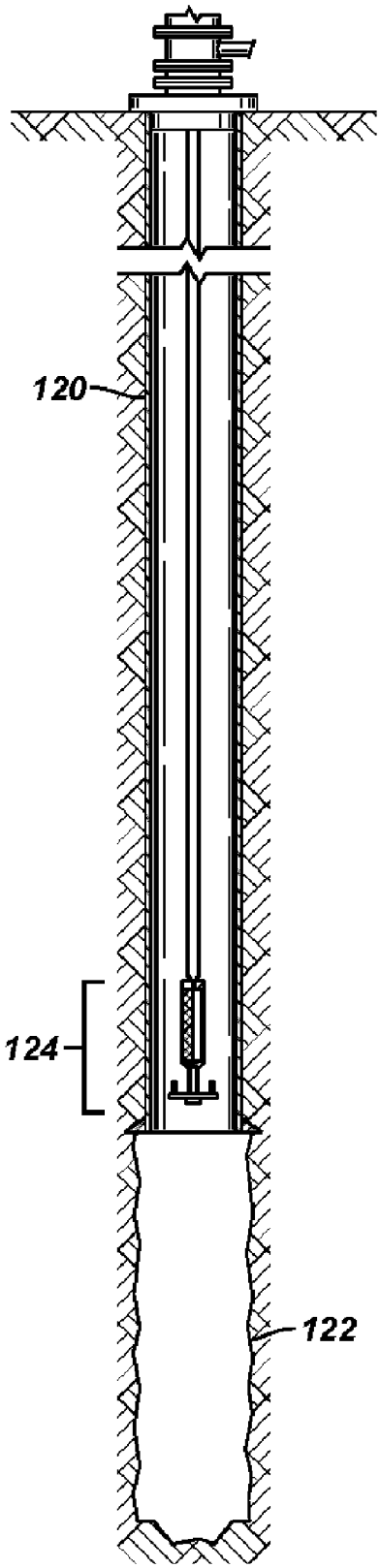

FIG. 7 shows a plugging device 124 being run into well 118. Plugging device 124 is designed to temporarily suspend or block production from producing zones below plugging device 124. As stated above, various types of plugging devices 124 can be used. For example, plugging device 124 may be a retrievable plug set mechanically or by wireline, or an inflatable bridge plug run on coiled tubing 116. In some configurations a double flapper check valve, a pump out plug, a plug catcher, and a circulating nozzle may be run as part of well plugging device 124. If a particular application so requires, additional components could be run as part of plugging device 124 as well.

Figure 8:
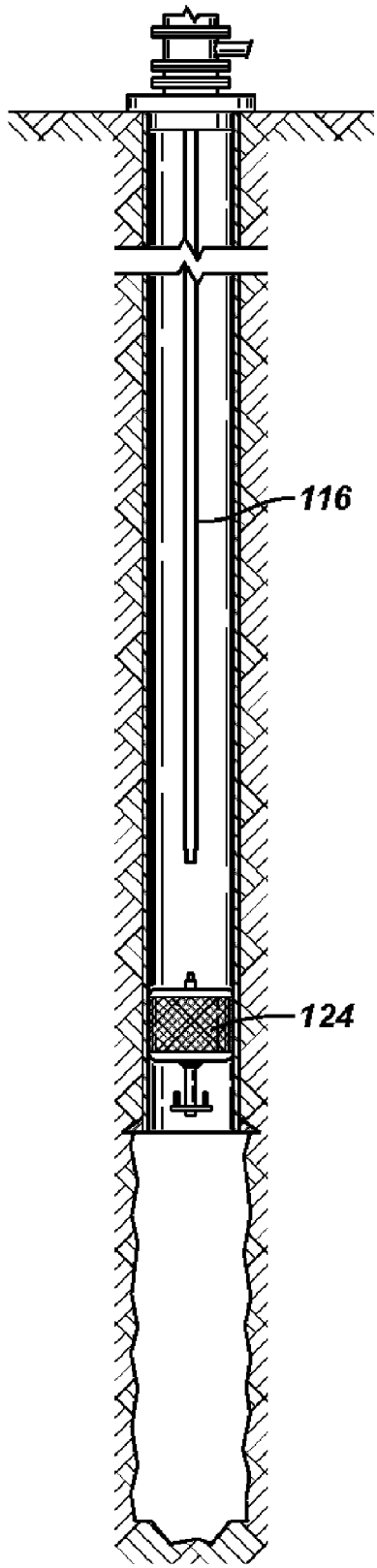

Once plugging device 124 is run in to its desired depth in well 118, it is set or actuated to isolate the portion of well 118 above plugging device 124 from that below plugging device 124. A pressure test can be performed to insure pressure integrity of plugging device 124. The setting tool can be released from plugging device 124 and removed along with coiled tubing 116, as shown in FIG. 8.

Figure 9:
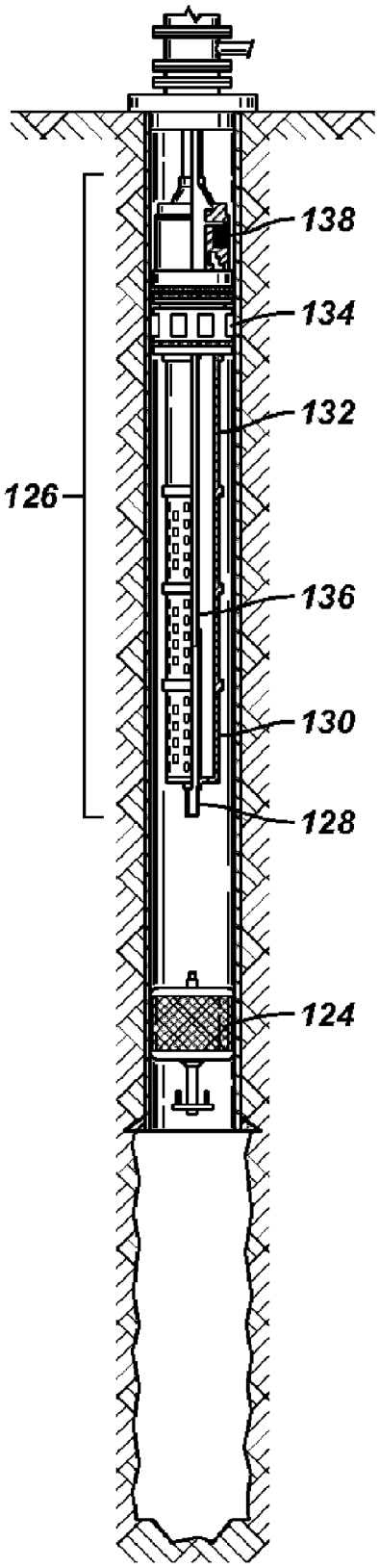
Figure 10:
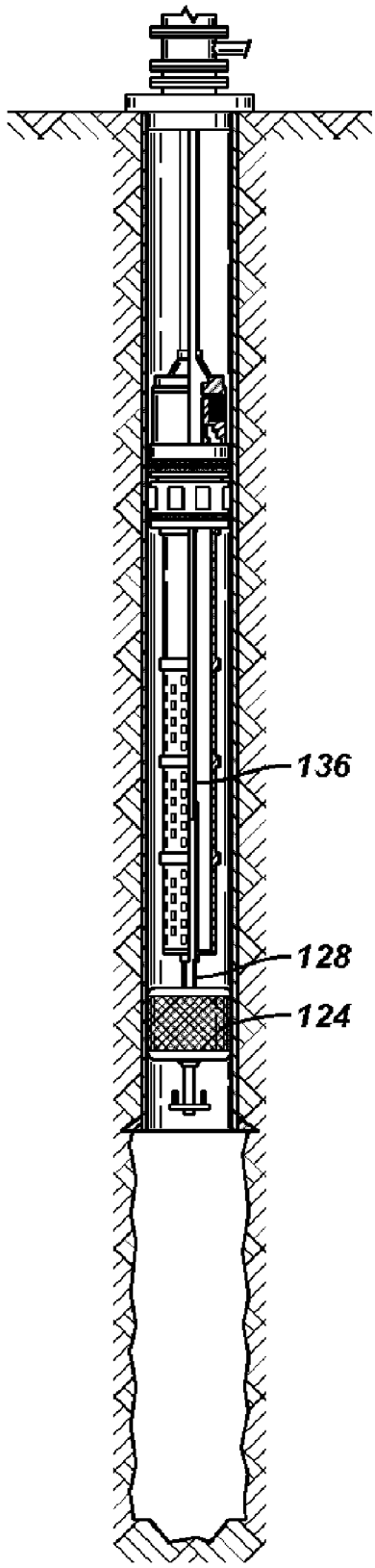
Figure 11:
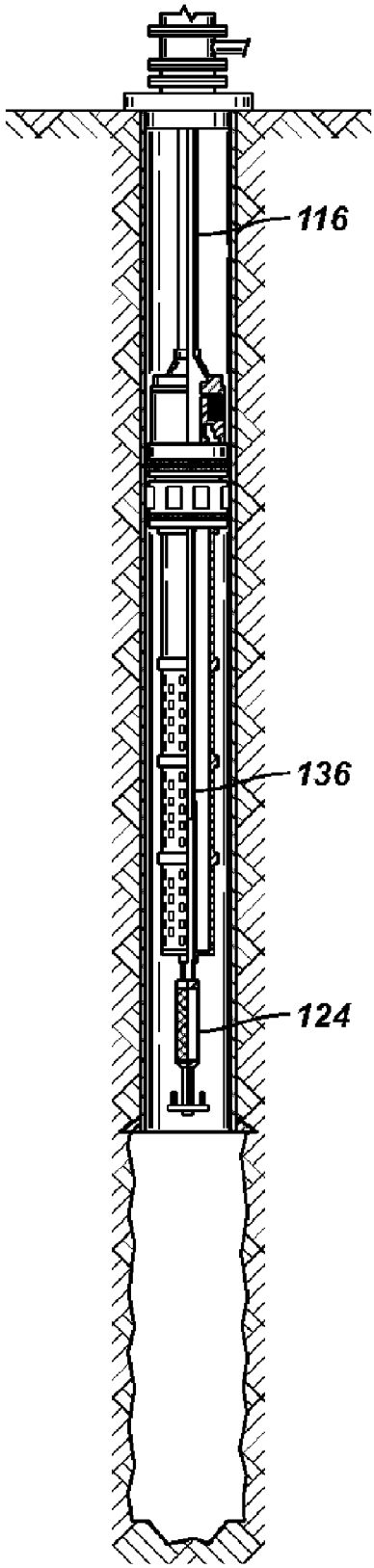

FIG. 9 shows a liner assembly 126 comprising an overshot 128, a screen 130, blank pipe 132, a liner hangar 134, an inner string 136, and a liner hangar setting tool 138. Liner assembly 126 can be as long as necessary and assembled while well 118 is maintained in an underbalanced condition by virtue of plugging device 124. Overshot 128 is releasably attached to inner string 136, for example, by shear pins. Inner string 136 extends from liner hangar 134 to overshot 128. Liner assembly 126 is run into well 118 on coiled tubing 116 such that overshot 128 joins plugging device 124, as shown in FIG. 10. Inner string 136 allows for fluid communication between coiled tubing 116 and plugging device 124. Plugging device 124 can then be deactivated (see FIG. 11).

Figure 12:
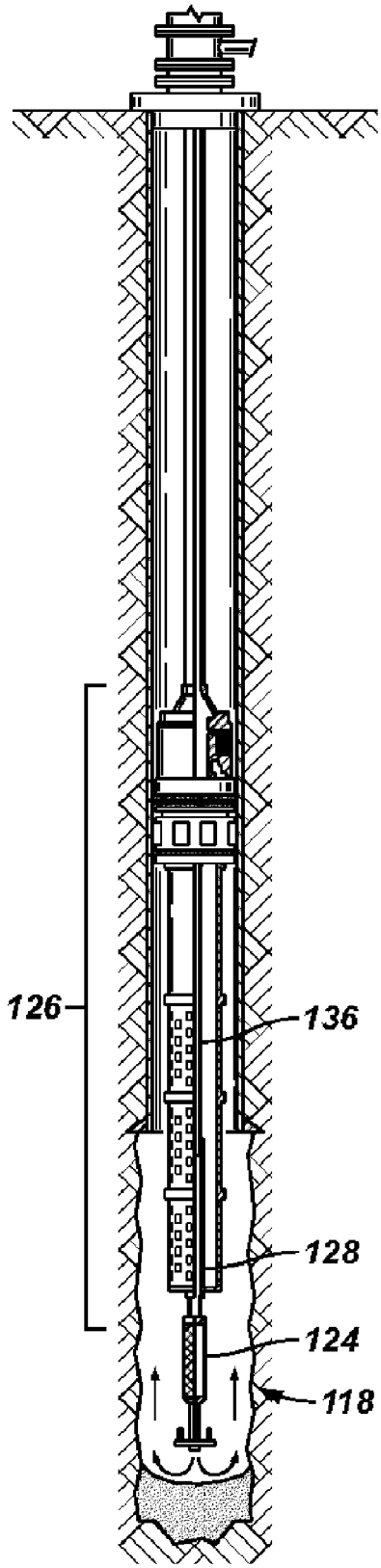
Figure 13:
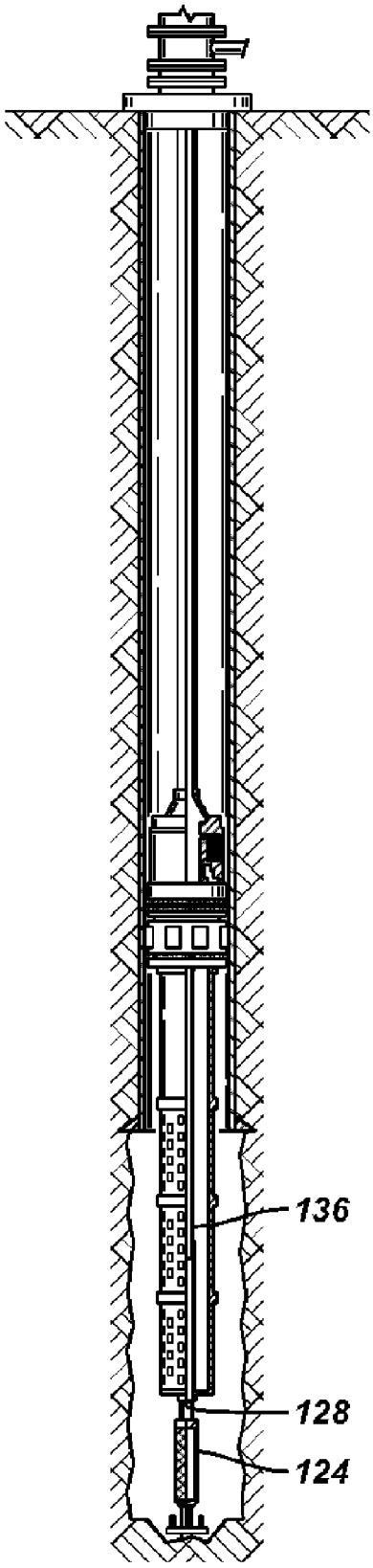
Figure 14:
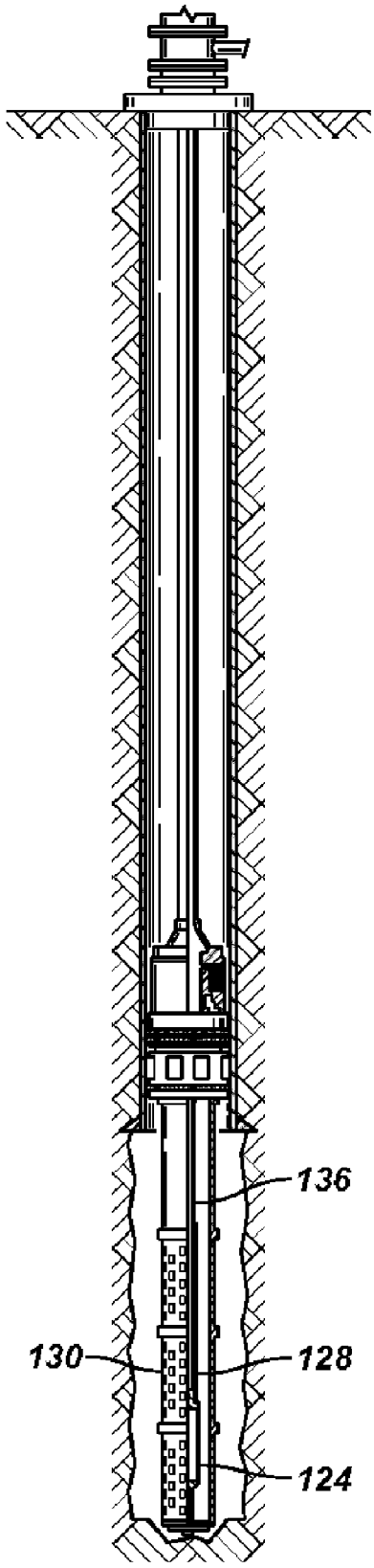

Liner assembly 126 can be further lowered into well 118 while any residual fill is circulated out of the hole, as shown in FIG. 12. When plugging device 124 reaches the total depth of well 118, weight can slowly be applied to release overshot 128 from inner string 136, for example, when the shear pins shear (see FIG. 13). That allows overshot 128 and plugging device 124 to retract within screen 130 as liner assembly 126 is lowered to the total depth of well 118 (see FIG. 14).

Figure 15:
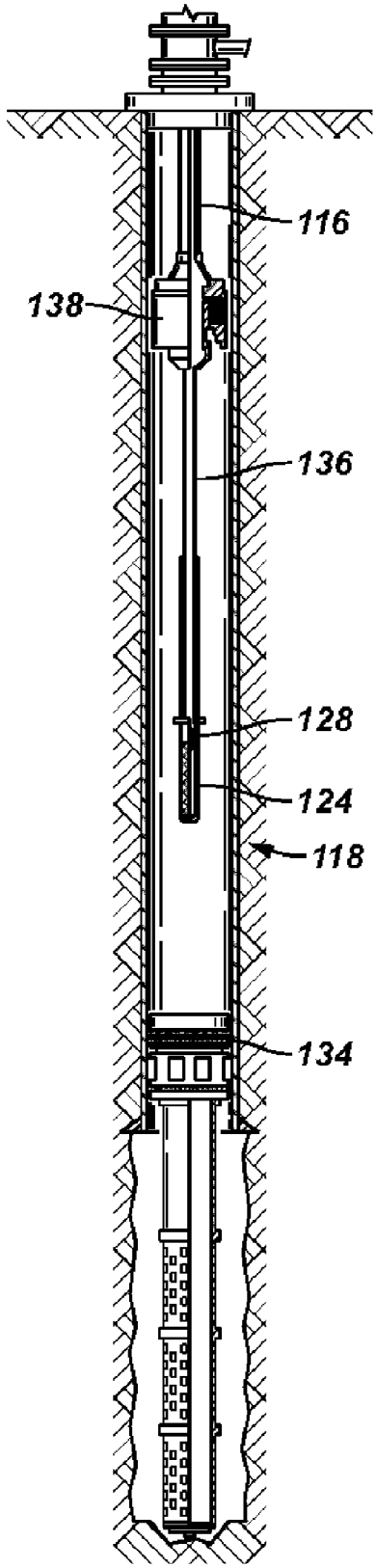

Liner hangar 134 can then be set using conventional means such as dropping a ball to seat in liner hangar setting tool 138. Once liner hangar 134 is set, liner hangar setting tool 138, along with overshot 128, inner string 136, and plugging device 124 can be released and removed from well 118 by coiled tubing 116, as shown in FIG. 15.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method to place a completion assembly in a well while maintaining the well in an underbalanced condition comprising:
- running a plug on a deployment tool to a desired depth in the well;
- setting the plug releasably in the well;
- retrieving the deployment tool;
- running the completion assembly on a setting tool into the well to engage the plug;
- releasing the plug;
- running the completion assembly and plug to a desired depth in the well;
- setting the completion assembly in the well; and
- retrieving the setting tool, including retrieving the plug.

2. The method of claim 1 in which the deployment tool is coiled tubing.

3. The method of claim 1 further comprising drilling the well to remove debris or obstructions.

4. The method of claim 3 in which the obstruction is a pre-existing plug.

5. The method of claim 1 further comprising circulating the well to remove debris.

6. The method of claim 1 further comprising placing an underbalancing fluid into the well.

7. The method of claim 6 in which the underbalancing fluid is nitrogen-foamed water.

8. The method of claim 1 further comprising pressure testing the integrity of the plug.

9. A method to refurbish a well in an underbalanced state comprising:
- removing obstructions from the well;
- injecting an underbalancing fluid into the well;
- running a plug into the well;
- releasably setting the plug in the well;
- releasing the pressure above the plug;
- assembling a completion assembly in an upper portion of the well;
- running the completion assembly on a setting tool into the well to engage and release the plug;
- running the completion assembly with the released plug attached to the assembly to a desired location in the well;
- setting the completion assembly in the well; and
- removing the setting tool, including removing an inner portion of the completion assembly and the plug.

10. The method of claim 9 further comprising blowing the well dry.

11. The method of claim 9 in which removing obstructions includes removing a pre-existing plug or debris.

12. The method of claim 11 in which removing obstructions includes drilling the well to remove the pre-existing plug or debris.

13. The method of claim 9 further comprising circulating well fluid to clean the well.

14. A method to place a completion assembly in a well while maintaining the well in an underbalanced condition comprising:
- running a plug on a deployment tool to a desired depth in the well;
- setting the plug releasably in the well;

retrieving the deployment tool;

running the completion assembly on a setting tool into the well to engage the plug;

releasing the plug;

running the completion assembly and plug to a desired depth in the well;

setting the completion assembly in the well;

retrieving the setting tool, including retrieving the plug; and lowering the completion assembly to force the plug into an interior region of the completion assembly prior to setting the completion assembly.

15. The method of claim 14 in which the deployment tool is coiled tubing.

16. The method of claim 14 further comprising drilling the well to remove debris or obstructions.

17. The method of claim 16 in which the obstruction is a pre-existing plug.

18. The method of claim 14 further comprising circulating the well to remove debris.

19. The method of claim 14 further comprising placing an underbalancing fluid into the well.

20. The method of claim 19 in which the underbalancing fluid is nitrogen-foamed water.

21. The method of claim 14 further comprising pressure testing the integrity of the plug.

* * * * *